United States Patent [19]

Matyas

[11] 4,386,646

[45] Jun. 7, 1983

[54] FOLDING DOOR HARDWARE

[75] Inventor: George W. Matyas, Detroit, Mich.

[73] Assignee: Alliance Metal Products Inc., Detroit, Mich.

[21] Appl. No.: 372,646

[22] Filed: Apr. 28, 1982

[51] Int. Cl.[3] ..... E05D 15/26

[52] U.S. Cl. ..... 160/206; 16/249

[58] Field of Search ..... 160/206, 351; 16/229, 16/236, 357, 361, 249

[56] References Cited

U.S. PATENT DOCUMENTS

| | | | |
|---|---|---|---|
| 3,683,453 | 8/1972 | McLeland | 160/206 |
| 3,895,670 | 7/1975 | Bates | 160/351 |
| 3,987,837 | 10/1976 | Hewson | 160/206 |
| 4,106,158 | 8/1978 | Kellems | 160/206 |
| 4,109,346 | 8/1978 | Strozier | 160/206 |

*Primary Examiner*—Peter M. Caun
*Assistant Examiner*—Cherney S. Lieberman
*Attorney, Agent, or Firm*—Barnes, Kisselle, Raisch, Choate, Whittemore & Hulbert

[57] ABSTRACT

A folding door having panels pivoted about vertical axes, top and bottom pivot assemblies, the bottom assembly comprising a bracket mountable beneath the door. The bracket defines a track along which a pivot block is guided. A sleeve is mounted in a vertical opening of the door and a pivot pin threaded into the sleeve, which pin is vertically adjustable relative to the door. The block has a vertical opening therein and the pivot pin has a lower end thereof extending therethrough. The pin and block have vertical teeth which are engaged when the pin is moved relatively downward onto said block and are disengaged when the pin is moved relatively upwardly. The pivot block and the bracket have vertically engageable teeth such that when the block is moved downwardly onto the bracket, the teeth are engaged, and when moved upwardly, the teeth are disengaged. The pin and block are constructed and arranged such that upon lifting the door, first the pivot pin teeth are disengaged from the block teeth permitting the pivot pin to be rotated to adjust the door vertically, and upon further lifting the block teeth will disengage from the bracket teeth permitting horizontal adjustment of the block relative to the bracket. Further lifting of the door disengages the pivot pin from the block when the pivot block contacts the bracket causing pressure to snap the pivot pin out of the block opening.

27 Claims, 11 Drawing Figures

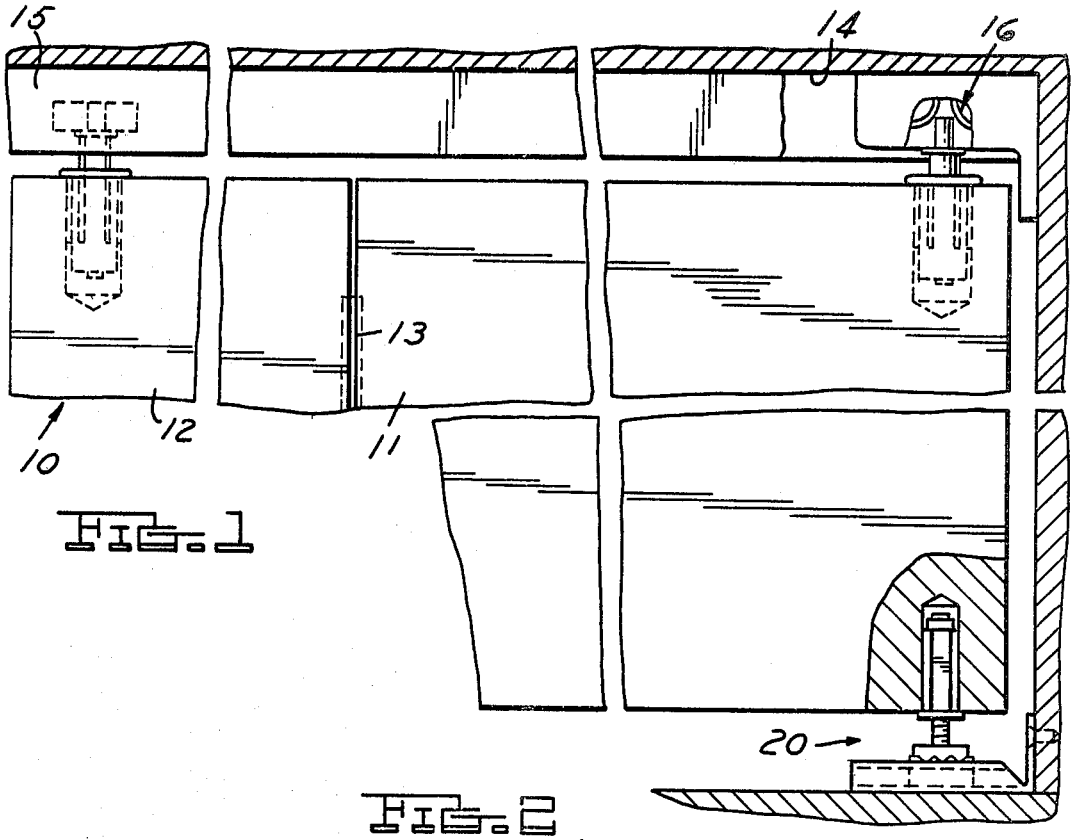
FIG. 1
FIG. 2
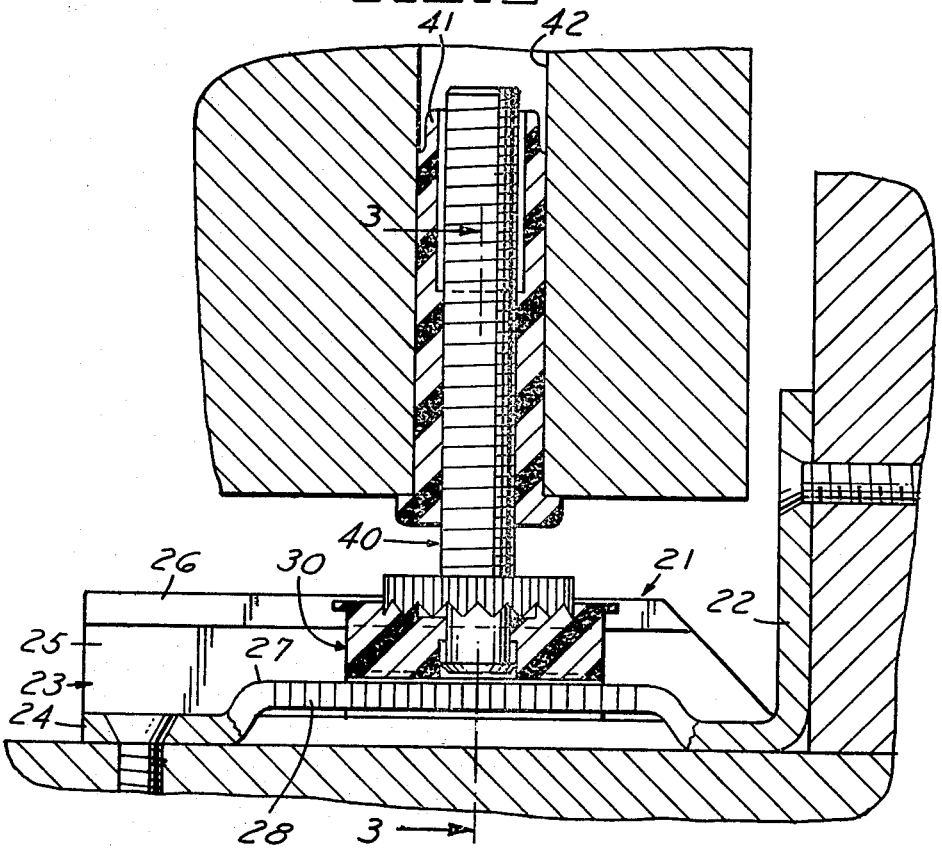

FOLDING DOOR HARDWARE

This invention relates to folding door hardware and particularly to the bottom pivot assemblies for folding doors.

BACKGROUND AND SUMMARY OF THE INVENTION

In folding doors comprising a plurality of door sections pivotally mounted with respect to one another about vertical axes, it is common to utilize a stationary upper pivot assembly mounted on an upper track which guides the sections and a bottom pivot assembly. It is desirable to provide in the bottom pivot assembly for both vertical and horizontal adjustment of the bottom pivot to accommodate the door opening. Many bottom pivot assemblies have been heretofore suggested for providing such vertical and horizontal adjustment.

For example, in U.S. Pat. No. 3,054,447, there is disclosed an arrangement wherein the bottom pivot comprises a pivot pin threaded into a sleeve in an opening in the bottom of the door that engages an opening in a bracket section that is, in turn, fastened but longitudinally adjustable by nut and bolt along a slot in a bottom bracket member. In order to adjust the door horizontally, the nut and bolt are loosened and the bracket section is moved. In order to adjust the door vertically, the pivot pin is rotated. However, there is nothing to prevent the rotation from occurring during the normal opening and closing of the doors so vertical adjustment can be lost. In U.S. Pat. No. 3,096,539, the pivot pin engages a member that is adjustable on the bottom pivot by rotation of a horizontal gear with a gear rack on the bottom pivot member. No provision is made for vertical adjustment. In U.S. Pat. No. 3,187,800, the pivot pin engages a socket in a pivot block that is, in turn, engaged with teeth on a bottom bracket. The vertical adjustment is achieved by threading or rotating the pivot pin. The horizontal adjustment is made by moving the pivot block to a new position along the track. A lock nut is utilized to the vertical adjustment position. In U.S. Pat. No. 3,233,657, the bottom pivot pin selectively engages one of the undulations of a member. However, in such an arrangement, the horizontal adjustment can be inadvertently changed by normal movement of the door.

In U.S. Pat. No. 3,328,832, the bottom pivot engages an opening in an intermediate member that is lifted to disengage teeth thereon from the bottom bracket to adjust the door horizontally. In U.S. Pat. No. 3,683,453, the bottom pivot has teeth thereon engaging corresponding teeth in a bolt for holding the vertical adjustment of the door. The bolt extends through an elongated opening in the bottom bracket and a nut is threaded on the bolt to lock the horizontal adjusted position. In such an arrangement, tools are required to make the horizontal adjustement. In U.S. Pat. No. 3,866,658, the bottom pivot pin engages an opening in a block that, in turn, has teeth thereon for engaging teeth on the bracket to provide horizontal adjustment. The pin is rotated to give vertical adjustment and a lock nut is used for locking the vertical adjusted position. In U.S. Pat. No. 4,106,158, the pivot pin has teeth thereon which engage complementary teeth on the bottom bracket. Vertical adjustment is achieved by rotating the pivot pin but there is no provision for locking the position of the pin. In the preferred form, the teeth are tapered downwardly and inwardly such that they can be disengaged in the normal operation of the door. In U.S. Pat. No. 4,109,346, the pivot pin engages a socket in a block that, in turn, has teeth thereon engaging teeth on the bottom bracket. Vertical adjustment is achieved by rotating a pivot pin and the pivot pin has a chisel point that engages the complementary socket for locking the pin in vertical adjusted position. The pivot block includes an integral spring that tends to urge the teeth of the block out of engagement with the teeth of the bracket and the teeth are shaped and positioned such that a longitudinal force on the door tends to disengage the teeth.

Among the objectives of the present invention are to provide a bottom pivot assembly which permits vertical and horizontal adjustment of the bottom pivot pin relative to the door without removing the door and wherein one adjustment will not affect the other; wherein the adjustment can be achieved without the use of tools; wherein the adjusted position, both vertically and horizontally, will be held and not affected by the normal operation of the door; and wherein the assembly can be manufactured at low cost.

In accordance with the invention, the bottom pivot assembly comprises a bracket adapted to be mounted beneath a section of the door. The bracket defines a track and a pivot block is guided along the track by the bracket. A sleeve is adapted to be mounted in a vertical opening in the lower end of a section of the door. The sleeve and the pivot pin have interengaging threads such that the pivot pin is vertically adjustable relative to the door. The block has a vertical opening therein and the pivot pin has the lower end thereof extending through the opening. The pin and the block have vertically engageable and disengageable teeth such that the teeth are engaged when the pin is moved relatively downward onto the block and said teeth are disengaged when said pin is moved relatively upward with respect to the block. The pivot block and the bracket have vertically engageable and disengageable teeth such that when the block is moved downwardly onto the bracket, said teeth are engaged, and when said block is moved upwardly relative to the bracket, the teeth are disengaged. Interengaging means between the pin and the block are operable upon lifting the door to lift the block and disengage the teeth of the block from the teeth of the bracket such that the teeth of the pivot pin are first disengaged from the teeth of the block permitting the pivot pin to be rotated to adjust the door vertically, and further lifting of the door will cause the interengaging means between the pin and the block to lift the block to disengage the teeth of the block from the teeth of the bracket permitting horizontal adjustable of the block relative to the bracket. Further lifting of the door disengages the pivot pin from the block when the pivot block contacts the bracket causing pressure to snap the pivot pin out of the opening in the pivot block.

DESCRIPTION OF THE DRAWINGS

FIG. 1 is a fragmentary part sectional view of a door embodying the invention.

FIG. 2 is a fragmentary sectional view of the bottom pivot assembly showing the normal position of the parts and taken along the line 2—2 in FIG. 3.

DESCRIPTION

Figure 3:
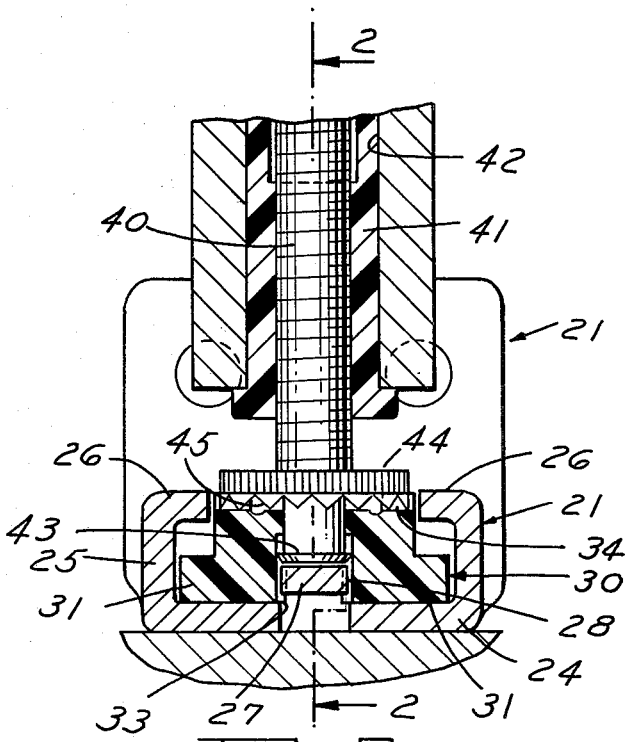
FIG. 3 is a fragmentary sectional view taken along the line 3—3 in FIG. 2.

Referring to FIG. 1, the invention relates to a folding door 10 that comprises a plurality of sections or panels 11, 12 that are hinged to one another as at 13 about a vertical axis. The panel 11 is pivoted to the top and bottom of a door opening 14 while the panel 12 is guided in its folding and unfolding movement by a downward opening U-shaped track 15. An upper pivot assembly 16 is provided for pivoting the panel 11 to the door opening at the upper end and may be of the type shown in U.S. Pat. No. 3,410,330 which is incorporated herein by reference.

Figure 4:
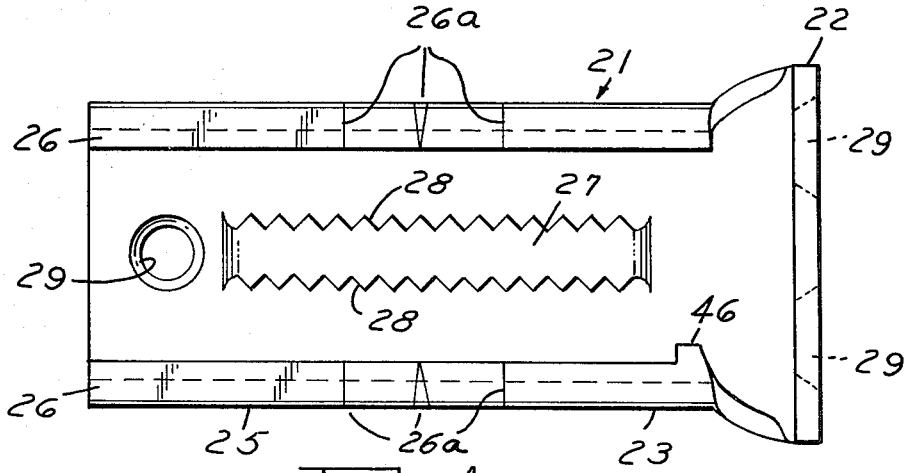
FIG. 4 is a plan view of the bracket that forms part of the bottom pivot assembly.

The bottom pivot assembly 20 comprises an L-shaped bracket 21 (FIG. 4) having a vertical wall 22 and a horizontal portion 23 and is preferably made of metal. The horizontal portion 23 defines a track and includes a bottom wall 24, vertical side walls 25 extending upwardly from the bottom wall and inwardly extending flanges 26 extending from the upper edges of the side walls 25. A strip 27 is deformed upwardly from the bottom wall 24 and includes two rows of teeth 28 that face outwardly in opposite directions along the sides of the strip. Openings 29 are provided in the wall 24 and 22 through which screws extend for fastening the bracket 21 to the floor and jamb.

Figure 7:
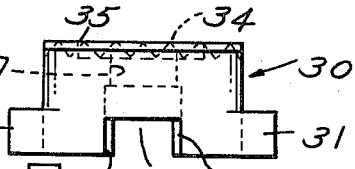
FIG. 7 is an end view of a pivot block that forms part of the pivot assembly.
Figure 8:
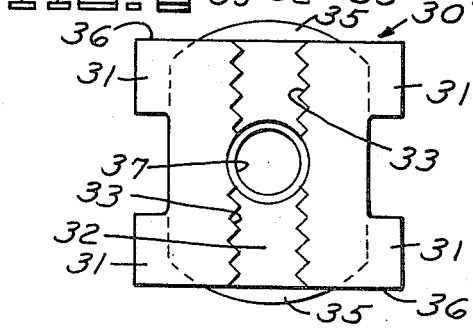
FIG. 8 is a bottom plan view of the pivot block.
Figure 9:
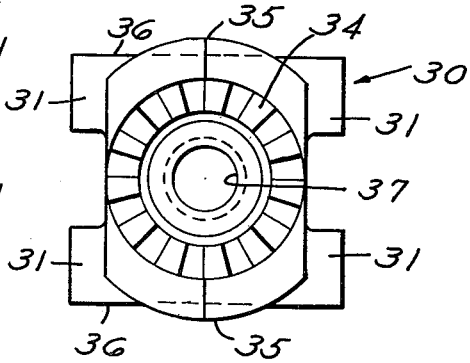
FIG. 9 is a top plan view of the pivot block.

A pivot block 30 made of synthetic plastic material such as nylon is provided in the track defined by the bottom wall 24 and side walls 25 of the bracket 21. As shown in FIGS. 7–9, the block 30 is generally rectangular and includes outwardly extending longitudinally spaced flange portions 31 that extend from the block and are adapted to contact the inner surface of the side wall 25 to guide the block 31 horizontally. The upper surface of block 31 extends generally at the level of the flanges 26. The block 30 is formed with a groove 32 in the undersurface thereof having two rows of integrally spaced teeth 33 in the sides of the groove which engage the teeth 28 on the bracket 21. The vertical extent of the teeth 33 is greater than the vertical extent of the teeth 28 (FIG. 7). The upper surface of the block is formed with a plurality of teeth 34 in an annular or circular array, each tooth being preferably V-shaped and having an obtuse included angle (FIG. 7). The pivot block 30 also includes curved flanges 35 extending from the upper surface beyond the confines of the end walls 36 (FIGS. 8,9) to allow the block to be grasped more easily when initially placing the block in position. Markings 26*a* and the hole 37 are aligned to indicate approximate positions of hole 37 depending on the location of opening 42 in the door relative to the side edge of door section 11. The pivot block 30 also includes a vertical opening 37 which intersects the groove 32 dividing the two rows of teeth into spaced segments.

The bottom pivot assembly further includes a pivot pin 40 threaded into a sleeve 41 that is made of organic plastic material and is forced into an opening 42 in the bottom of the section 11 of the door. The lower end of the pivot pin 40 engages the opening 37 in the pivot block and has a radial bead 43 that snaps past the lower edge of the opening 37 in the pivot block 30 (FIG. 2). The pivot pin 40 also includes a flange 44 having an annular array of downwardly facing teeth 45 on the undersurface thereof complementary to the teeth 34. Teeth 45 and 34 normally engage to lock the pivot pin 40 in position against rotation thereby locking the vertical adjustment of the pivot pin 40. (FIGS. 2, 3)

A lip 46 extends inwardly from one of the flanges 26 to prevent the pivot block 30 from coming too close to the door jamb so that it would become wedged at an angle to the teeth locking it in position so that it would be difficult to remove. This also helps maintain the block far enough away from the door jamb that the doors would be so close to the door jamb that the teeth on the underside of the block might be sheared off by movement of the door.

Figure 5:
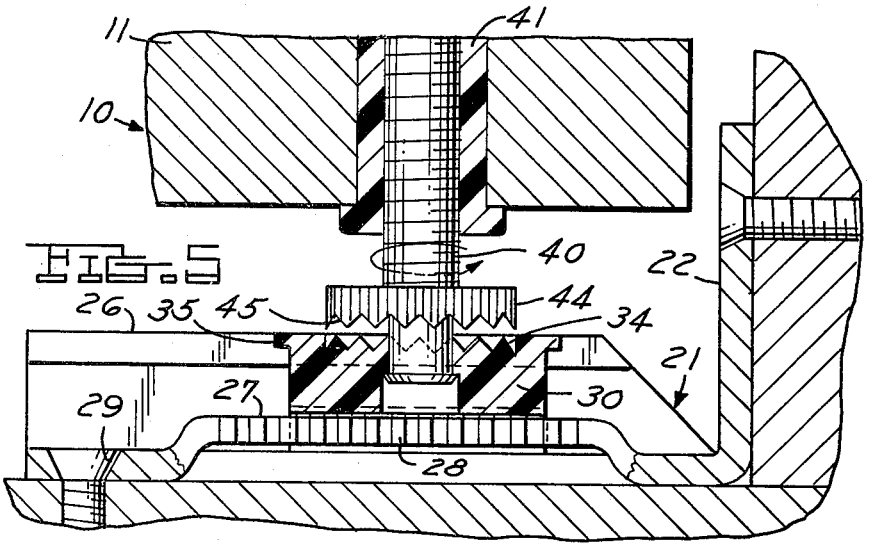
FIG. 5 is a fragmentary sectional view showing the relative position of the parts during vertical adjustment of the bottom pivot pin.

Referring to FIG. 5, if it is desired to adjust the vertical position, the door is lifted, lifting the pivot pin 40 relative to the pivot block 30 sufficiently to disengage the teeth 45, 34 permitting the pivot pin 40 to be rotated by manual engagment by rotating flange 44 on the pivot pin 40. After the adjustment, lowering the door will reengage the teeth to lock the vertical adjustment of the door.

Figure 6:
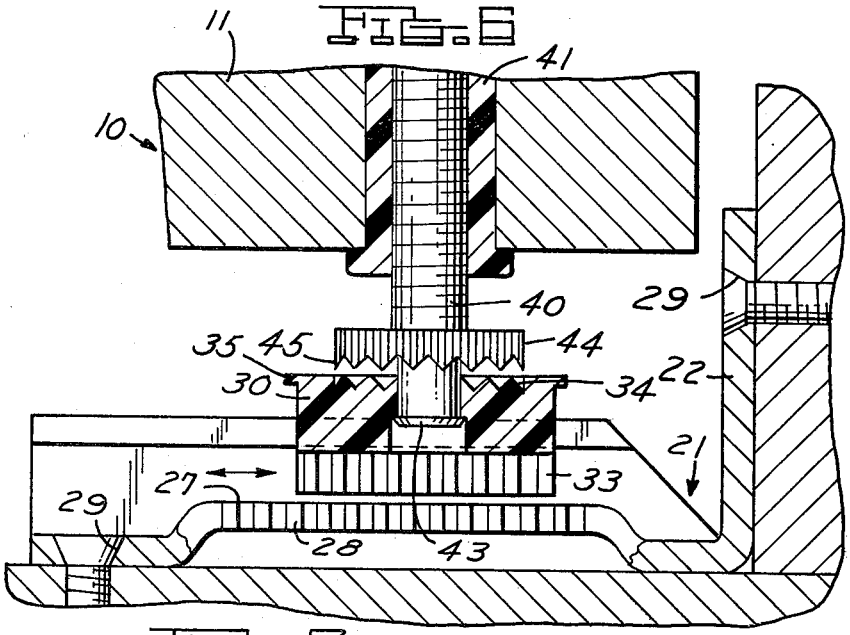
FIG. 6 is a fragmentary sectional view showing the relative position of the parts during horizontal adjustment of the pivot pin.
Figure 10:
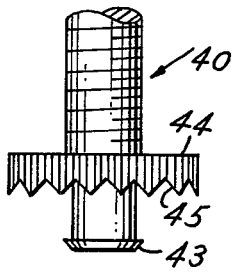
FIG. 10 is a fragmentary elevational view of a pivot pin utilized in the bottom pivot assembly.
Figure 11:
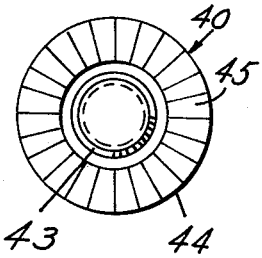
FIG. 11 is a bottom plan view of the pivot pin.

Referring to FIG. 6, if it is desired to adjust the pivot pin 40 horizontally, the door is lifted not only to disengage the teeth 45, 34 between the pivot pin 40 and pivot block 30 but also a further distance to lift the pivot block 30 by engagement of the bead 43 on the pivot pin 40 with the block at the lower end of the opening 37 to disengage the teeth 33 on the pivot block 30 from the teeth 28 on the bottom bracket so that the pivot block 30 can be moved horizontally to the desired adjusted position. Upon lowering of the door, the teeth 33 on the pivot block 30 engage the teeth 28 on the bracket 21 to lock the horizontal adjustment of the door. Further lifting of the door disengages the pivot pin 40 from block 30 when the flange portions 31 contact the flanges 26 on bracket 21 causing pressure to snap the bead 43 to snap out of opening 37 in the pivot block 30.

It can thus be seen that there has been provided a bottom pivot assembly which will permit both vertical and horizontal adjustment without the use of tools and wherein the adjustment is maintained and not adversely affected by normal operation of the door.

I claim:

1. For use in a folding door which comprises a plurality of panels pivoted to one another about vertical axes, a top pivot assembly and a bottom pivot assembly wherein the bottom pivot assembly comprises a bracket adapted to be mounted beneath a section of the door, said bracket defining a track, a pivot block guided along said track by said bracket, a pivot pin, a sleeve adapted to be mounted in a vertical opening in the lower end of a section of the door, said sleeve and said pivot pin having interengaging threads such that the pivot pin is vertically adjustable relative to the door, said block having a vertical opening therein, said pivot pin having the lower end thereof extending through said opening, first vertically engageable and disengageable means between said pin and said block such that said first means are engaged when the pin is moved relatively downward onto said block and said first means are disengaged when said pin is moved relatively upward with respect to said block, second vertically engageable and disengageable means between said pivot block and said bracket such that when the block is moved downwardly onto the bracket, said second means are engaged, and when said block is moved upwardly relative to said bracket, said second means are disengaged, and third means between said pin and said block operable upon lifting the door to disengage the first means between the pivot pin and the block and when said first means are disengaged permitting the pivot pin to be rotated to adjust the door vertically, and further lifting of the door will cause said third means between the pin and the block to lift the block to disengage said second means between the block and the bracket and when said second means are disengaged permitting horizontal adjustable of the block relative to the bracket.

2. The bottom pivot assembly set forth in claim 1 wherein said first vertically engageable and disengageable means comprises teeth on said pin and said block.

3. The bottom pivot assembly set forth in claims 1 or 2 wherein said second vertically engageable means comprises teeth on said pivot block and said bracket.

4. The bottom pivot assembly set forth in claim 3 wherein said bracket includes a bottom wall, upwardly extending side walls and inwardly extending flanges extending from said side walls into overlying relationship with a portion of the pivot block, said teeth on said bracket comprising two longitudinally extending rows of teeth facing outwardly from one another, said pivot block having flange portions beneath the flanges of the bracket, said pivot block having a longitudinally extending groove on the undersurface thereof, said teeth on said pivot block comprising two longitudinally extending rows of teeth facing one another.

5. The pivot assembly set forth in claim 4 wherein said bracket is made of metal, said bracket having a longitudinally extending strip thereof deformed upwardly from the remainder of said bracket and having said row teeth along the edges thereof.

6. The pivot assembly set forth in claim 5 wherein said bracket is L-shaped including a horizontal portion from which said strip is deformed and a vertical portion adapted to be fastened to the jamb of the opening.

7. The pivot assembly set forth in claim 4 wherein said pivot block includes straight sides and curved end portions to facilitate grasping and positioning of the pivot block in the bracket.

8. The pivot assembly set forth in claim 7 wherein said flange portions of said pivot block comprise spaced outwardly extending portions.

9. The pivot assembly set forth in claim 4 wherein the teeth on said pivot block have a greater vertical extent than the teeth on said bracket.

10. The pivot assembly set forth in claim 4 wherein said opening in said pivot block intersects said rows of teeth to divide each row into at least two portions.

11. The pivot assembly set forth in claim 1 wherein said first interengaging means between said pivot pin and said block comprises an annular array of teeth on the upper surface of said block and a complementary annular array of teeth facing downwardly on said pin.

12. The pivot assembly set forth in claim 11 wherein said complementary teeth on said pivot block and said pin are generally V-shaped.

13. The pivot assembly set forth in claim 12 wherein said teeth comprise an obtuse included angle.

14. The pivot assembly set forth in claim 1 wherein said pivot pin includes a radially extending wall above said teeth for manually grasping the pin to rotate it.

15. The pivot assembly set forth in claim 1 wherein said bracket includes longitudinally spaced markings defining indicia for indicating positions of the pivot block along said track of said bracket.

16. The pivot assembly set forth in claim 1 wherein said second interengaging means operable between said pivot pin and said block comprises a radial bead on said pivot pin engageable with the lower end of the vertical opening in said pivot block.

17. For use in a folding door which comprises a plurality of panels pivoted to one another about vertical axes and a stationary top pivot assembly and a stationary bottom pivot assembly wherein the bottom pivot assembly comprises a bracket adapted to be mounted beneath a section of the door, said bracket defining a track, a pivot block guided along said track by said bracket, a pivot pin, a sleeve adapted to be mounted in a vertical opening in the lower end of a section of the door, said sleeve and said pivot pin having interengaging threads such that the pivot pin is vertically adjustable relative to the door, said block having a vertical opening therein, said pivot pin having the lower end thereof extending through said opening, said pin and said block having vertically engageable and disengageable teeth such that the teeth are engaged when the pin is moved relatively downward onto said block and said teeth are disengaged when said pin is moved relatively upward with respect to said block, said interengaging teeth between said pivot pin and said block comprises an annular array of teeth on the upper surface of said block and complementary annular array of teeth facing downwardly on said pin, said pivot block and said bracket having vertically engageable and disengageable teeth such that when the block is moved downwardly onto the bracket, said teeth are engaged, and when said block is moved upwardly relative to said bracket, said teeth are disengaged, said bracket includes a bottom wall, upwardly extending side walls and inwardly extending flanges extending from said side walls into overlying relationship with a portion of the pivot block, said teeth on said bracket comprising two longitudinally extending rows of teeth facing outwardly from one another, said pivot block having flange portions beneath the flanges of the bracket, said pivot block having a longitudinally extending groove on the undersurface thereof, said teeth on said pivot block comprising two longitudinally extending rows of teeth facing one another, and means between said pin and said block comprising a radial bead on said pivot pin adapted to engage said pivot block at the lower end of the vertical opening in said pivot block and operable upon lifting the door to lift the block and disengage the teeth of the block from the teeth of the bracket such that when the door is lifted, the teeth of the pivot pin are first disengaged from the teeth of the block permitting the pivot pin to be rotated to adjust the door vertically, and further lifting of the door will cause said interengaging means between the pin and the block to lift the block to disengage the teeth of the block from the teeth of the bracket permitting horizontal adjustable to the block relative to the bracket.

18. The pivot assembly set forth in claim 17 wherein said complementary teeth on said pivot block and said pin are generally V-shaped.

19. The pivot assembly set forth in claim 18 wherein said teeth comprise an obtuse included angle.

20. The pivot assembly set forth in claim 18 wherein said pivot pin includes a radially extending wall above said teeth for manually grasping the pin to rotate it.

21. The pivot assembly set forth in claim 17 wherein said bracket includes longitudinally spaced markings defining indicia for indicating positions of the pivot block along said track of said bracket.

22. The pivot assembly set forth in claim 17 wherein said bracket is made of metal, said bracket having a longitudinally extending strip thereof deformed upwardly from the remainder of said bracket and having said row teeth along the edges thereof.

23. The pivot assembly set forth in claim 22 wherein said bracket is L-shaped including a horizontal portion from which said strip is deformed and a vertical portion adapted to be fastened to the jamb of the opening.

24. The pivot assembly set forth in claim 17 wherein said pivot block includes straight sides and curved end portions to facilitate grasping and positioning of the pivot block in the bracket.

25. The pivot assembly set forth in claim 24 wherein said flange portions of said pivot block comprise spaced outwardly extending portions.

26. The pivot assembly set forth in claim 17 wherein the teeth on said pivot block have a greater vertical extent then the teeth on said bracket.

27. The pivot assembly set forth in claim 17 wherein said opening in said pivot block intersects said rows of teeth to divide each row into at least two portions.

* * * * *